US011203727B2

(12) United States Patent
Korinek et al.

(10) Patent No.: US 11,203,727 B2
(45) Date of Patent: Dec. 21, 2021

(54) COMPOSITION FOR REDUCING EMISSIONS, CARBON DEPOSITS AND FUEL CONSUMPTION

(71) Applicants: Arnost Korinek, Kurim (CZ); Martin Luptak, Drozdin (CZ); Marek Vavrusa, Hvozdna (CZ)

(72) Inventors: Arnost Korinek, Kurim (CZ); Martin Luptak, Drozdin (CZ); Marek Vavrusa, Hvozdna (CZ)

( * ) Notice: Subject to any disclaimer, the term of this patent is extended or adjusted under 35 U.S.C. 154(b) by 0 days.

(21) Appl. No.: 16/632,058

(22) PCT Filed: Jul. 17, 2018

(86) PCT No.: PCT/CZ2018/050038
§ 371 (c)(1),
(2) Date: Jan. 17, 2020

(87) PCT Pub. No.: WO2019/015703
PCT Pub. Date: Jan. 24, 2019

(65) Prior Publication Data

US 2020/0157443 A1 May 21, 2020

(30) Foreign Application Priority Data

Jul. 17, 2017 (CZ) ..... CZ2017-411

(51) Int. Cl.
*C10L 1/14* (2006.01)
*C10L 10/02* (2006.01)
(Continued)

(52) U.S. Cl.
CPC ..... *C10L 1/14* (2013.01); *C10L 10/02* (2013.01); *C10L 10/06* (2013.01); *C10L 1/1802* (2013.01);
(Continued)

(58) Field of Classification Search
CPC .. C10L 10/02; C10L 10/06; C10L 1/14; C10L 1/1802; C10L 1/1824;
(Continued)

(56) References Cited

U.S. PATENT DOCUMENTS 4,979,447 A 12/1990 Farrar
5,299,746 A 4/1994 Thuenker et al.
(Continued)

FOREIGN PATENT DOCUMENTS

CZ 295617 B6 8/2005
CZ 21385 U1 11/2010
(Continued)

OTHER PUBLICATIONS

International Search Report and Written Opinion in International patent application No. PCT/CZ2018/050038 completed on Oct. 22, 2018.
(Continued)

*Primary Examiner* — Latosha Hines
(74) *Attorney, Agent, or Firm* — Warner Norcross + Judd LLP

(57) ABSTRACT

A composition is disclosed. The composition is useful for reducing emissions, carbon deposits and fuel consumption when liquid hydrocarbon fuels are combusted. The composition comprises: from 80 to 90 percent (%) by weight of ferrocene; and one or more components selected from the group consisting of behenyl alcohol, hydrogenated cottonseed oil, and magnesium stearate, whereas each of the components (if present) is present in the composition in a maximum quantity of 10% by weight. Generally, at least behenyl alcohol is present, along with at least one of hydrogenated cottonseed oil and magnesium stearate. The composition can be prepared in the form of granulated material, which can be subsequently applied as such or can
(Continued)

Differences in selected parts of a combustion chamber at common operation and after periodic use of the technology be modified to another form (e.g. tablets, solutions, etc.). An additive for liquid hydrocarbon fuels is also disclosed.

13 Claims, 5 Drawing Sheets

(51) Int. Cl.

| | |
|---|---|
| ***C10L 10/06*** | (2006.01) |
| ***C10L 1/18*** | (2006.01) |
| ***C10L 1/182*** | (2006.01) |
| ***C10L 1/188*** | (2006.01) |
| ***C10L 1/30*** | (2006.01) |

(52) U.S. Cl.
CPC ..... *C10L 1/1824* (2013.01); *C10L 1/1881* (2013.01); *C10L 1/305* (2013.01); *C10L 2200/024* (2013.01); *C10L 2200/0213* (2013.01); *C10L 2230/22* (2013.01)

(58) Field of Classification Search
CPC ..... C10L 1/1881; C10L 1/305; C10L 2200/0213; C10L 2200/024; C10L 2230/22; C10L 2290/30; C10L 9/10; C10L 2300/22
See application file for complete search history.

(56) References Cited

U.S. PATENT DOCUMENTS

| | | | | |
|---|---|---|---|---|
| 5,456,217 | A | 10/1995 | Thunker et al. | |
| 5,746,784 | A | 5/1998 | Thunker et al. | |
| 2005/0060929 | A1 | 3/2005 | Caprotti et al. | |
| 2008/0263940 | A1* | 10/2008 | Parish | C10L 1/14 44/354 |
| 2011/0021396 | A1 | 1/2011 | Perry | |
| 2014/0360588 | A1 | 12/2014 | Bucher et al. | |
| 2016/0340599 | A1 | 11/2016 | Gui-Zhong | |

FOREIGN PATENT DOCUMENTS

| | | | | |
|---|---|---|---|---|
| CZ | 31070 | U1 | 10/2017 | |
| WO | 9936488 | A1 | 7/1999 | |
| WO | 2007/102747 | A1 | 9/2007 | |
| WO | WO-2007102747 | A1 * | 9/2007 | C10L 1/305 |
| WO | 2013010309 | A1 | 1/2013 | |

OTHER PUBLICATIONS

Fuel Additives: Uses and Benefits; Technical Committee of Petroleum Additive Manufacture in Europe, p. 23 to 40, published Sep. 2013.
J. Černý et al., Úsporné tablety do paliva—obchod s lidskou důvěřivostí (Economical fuel tablets—a business with human credibility), p. 9 to 12, published Aug. 2016.
Czech Priority Search Report completed on Mar. 28, 2018.
Machine translation of CZ31070U1 accessed on Feb. 17, 2020.
Machine translation of WO2013/010309 accessed on Feb. 17, 2020.
Machine translation of CZ295617 accessed on Feb. 17, 2020.
Machine translation of Úsporné tablety do paliva—obchod s lidskou důvěřivostí accessed on Feb. 17, 2020.
Machine translation of CZ21385U1 accessed on Feb. 19, 2020.

* cited by examiner

Differences in selected parts of a combustion chamber at common operation and after periodic use of the technology

COMPOSITION FOR REDUCING EMISSIONS, CARBON DEPOSITS AND FUEL CONSUMPTION

CROSS-REFERENCE TO RELATED APPLICATIONS

This application is the National Stage of International Appl. No. PCT/CZ2018/050038 filed on 17 Jul. 2018, which claims priority to and all advantages of Czech Republic Appl. No. PV 2017-411 filed on 17 Jul. 2017, the content of which is hereby incorporated by reference.

FIELD OF THE INVENTION

The present invention relates to the composition of a mixture for manufacturing an additive to be added to liquid hydrocarbon fuels for combustion engines or boilers. It is possible to manufacture an additive in the form of granulated material, tablets or a liquid solution out of this mixture. The tablets are easily applied in the process of dosing into tanks of vehicles or machines. They dissolve quickly enough when the fuel is moving inside the tanks. The granulated material can be easily applied into the tanks which are provided with a protective sieve against stealing at the tank filler neck. It is possible to use the granulated material for preparing a liquid solution to be applied into stationary tanks where the movement of the fuel is minimal. The granulated material can be added directly to solid fuels (for instance coal) before their being used in boilers. This renders the fuel far better properties in the process of combustion. The designed mixture functions as a combustion catalyst. Oxygen utilization is considerably improved. Among other things, a gradual and safe cleaning of inner combustion spaces in boilers and combustion engines, of valves, injections, plugs and measuring sensors, and of the whole exhaust system including catalytic converters and solid particles filters occurs. The measured gas emissions including dust particles are considerably decreased as well. The combustion motors dynamics is also improved. Even the fuel consumption is reduced.

BACKGROUND ART

Methods of cleaning inner parts of motors and of the exhaust system by adding additives of various compositions, in most cases in a liquid form composed of various chemical substances, are known in the background art. Most of them are single-purposely specialized just in cleaning of particular motor parts (injections, valves etc.) and only exceptionally in cleaning of the exhaust system. Since the commonly used liquid additives influence the chemical composition of the fuel, they are most often produced especially for an application in petrol or diesel oil. Practically none of the used additives reduces exhaust gases and particles emissions considerably. In case of using additives in a liquid form, the process of their dosing into the vehicle and machine tanks is cumbersome, for some users even unacceptable, due to the complexity of the application. A lot of motorists are discouraged even by an unpleasant smell of the already open vessels containing the additive when they are placed in vehicles. The dosing process may even lead to a deterioration of the user hygienic conditions.

There are known solutions where an organometallic compound known under the name of Ferrocen is used as an active ingredient. The use of the Ferrocen itself has not proved fully successful, the handling therewith is similarly complicated as the liquid additives dosing and moreover, it is difficult to dose its quantity properly. Effects of Ferrocen degrade quickly due to the effect of air humidity and solar radiation. The same situation occurs when Ferrocen is dissolved in hydrocarbon fuels and stored in transparent containers and at higher temperatures. Furthermore, ferrocen dissolves slowly in hydrocarbon fuels, especially in diesel oil. Moreover, it leaves residues (ashes) in the inner parts of combustion chambers and in the exhaust emission system.

Solutions in the form of tablets are also known, where the mixture was prepared from Ferrocen and other substances making it possible to produce the tablets by pressing or casting. However, the existing known solutions suffer from many problems. The tablets dissolve slowly and, moreover, they contain adjuvants that are not compatible with hydrocarbon fuels. Thereby they leave ashes in the motor combustion chamber and in the exhaust system. After some time, the ashes bring about problems in the motor and in the exhaust system.

SUMMARY OF THE INVENTION

The drawbacks mentioned above are eliminated by the composition of the mixture for the production of an additive in the form of granulated material, tablets or in a liquid solution for liquid hydrocarbon fuels. This composition consists of 80% to 90% of Ferrocen CAS: 102-54-5 and/or its derivatives, Behenyl alcohol CAS: 661-19-8, and of 0% to 10% of hydrogenated cottonseed oil, that is Lubritab CAS: 68334-00-9 and/or of 0% to 10% of magnesium stearate CAS: 557-04-0. It is necessary to treat the individual composition components by grinding and sifting through a sieve with sieve diameter of 0.2 to 0.5 mm. It is necessary to mix thoroughly these treated components and produce a homogenous mixture.

The present invention relates specifically to a composition (a mixture) for reducing emissions, carbon deposits and fuel consumption in the process of liquid hydrocarbon fuels and coal combustion, the composition containing from 80% to 90% by weight of Ferrocen and the rest is composed of Behenyl alcohol and one or more components selected from the group including hydrogenated cottonseed oil and magnesium stearate, wherein each of the components Behenyl alcohol, hydrogenated cottonseed oil and magnesium stearate is comprised in the composition in the maximum quantity of 10% by weight.

Examples of advantageous mixture compositions are as follows:

1) 80% by weight of Ferrocen, 10% by weight of Behenyl alcohol and 10% by weight of hydrogenated cottonseed oil, or
2) 80% by weight of Ferrocen, 5% by weight of Behenyl alcohol, 5% by weight of hydrogenated cottonseed oil and 10% by weight of magnesium stearate, or
3) 85% by weight of Ferrocen, 5% by weight of Behenyl alcohol, 5% by weight of hydrogenated cottonseed oil and 5% by weight of magnesium stearate, or
4) 90% by weight of Ferrocen, 5% by weight of Behenyl alcohol and 5% by weight of magnesium stearate.

However, it is possible to use a mixture with any other composition which falls within the mixture definition in patent claim 1.

The purity of Ferrocene used is 99.9%, free iron maximum 50 ppm, insoluble in benzene maximum 0.01%, water content is maximum 0.03%.

The additive for liquid hydrocarbon fuels, which is advantageously in the form of loose granulated material or a pressed tablet or in the form of a solution of the mixture in liquid hydrocarbon fuel, can be produced from the mixture mentioned above.

In case of a solution of the mixture in the liquid hydrocarbon fuel the additive contains advantageously 3 to 5% by weight of the mixture and the rest consists of the liquid hydrocarbon fuel, the mixture being completely dissolved in the fuel. As the liquid hydrocarbon fuel, a liquid hydrocarbon fuel for combustion engines propulsion is used. The liquid hydrocarbon fuel is preferably selected from the group including petrol, diesel oil, paraffin oil, aviation petrol, fuel oil and solvent naphtha.

The invention also relates to the combustion engine fuel that contains the mixture mentioned above. A preferred ratio of the mixture to the liquid hydrocarbon fuel ranges from 1 g of the mixture to 80 litres of the fuel up to 1 g of the mixture to 60 litres of the fuel, the mixture being completely dissolved in the fuel.

The mixture used guarantees a fast dissolution in petrol, diesel oil, fuel oil, paraffin oil, aviation petrol and LPG without any residual substances that would not burn down or that would form ashes.

The mixture is produced in the form of granulated material and is intended either for the direct application, for the production of tablets, or for the production of a liquid solution.

The weight of the tablets can be adapted according to the application thereof. A standard weight of the tablet is 0.5 g. It is possible to use such tablet per 40 litres of fuel for common use. Even a lower dilution ratio can be used, e.g. 1:30, to reach faster effects of cleaning the inner parts of combustion chambers.

When using the granulated material, it is recommended to use 1 g of the granulated material per 80 litres of the hydrocarbon fuel.

When producing a liquid solution, 25 g of granulated material are dissolved in 1 litre of the liquid hydrocarbon fuel. Such concentrate is intended for the treatment of 2000 litres of the fluid hydrocarbon fuel.

Throughout the description, unless anything else follows from the context, the word "contain" or "comprise" will be understood in such a way that it means incorporation of a number or a group of numbers mentioned, but not elimination of any other number or any other group of numbers from the mentioned ranges of percentage content of individual substances in the mixture.

EXAMPLES OF THE PREFERRED EMBODIMENTS OF THE INVENTION

Example 1

Figure 1A:
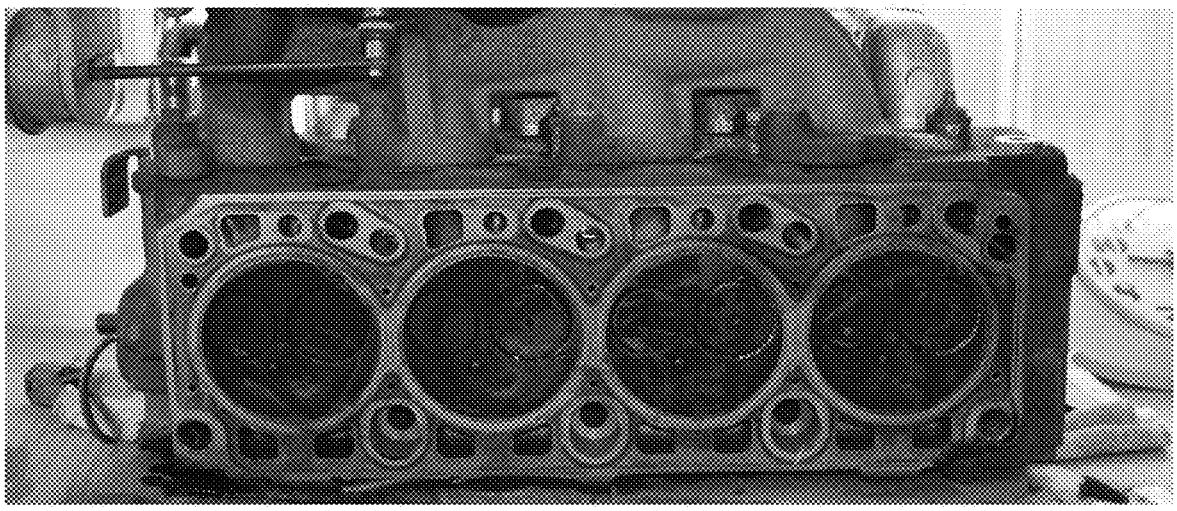
FIG. 1A shows a photo of a FORD Focus diesel motor, mileage 128 000 km, without using the additive.
Figure 1B:
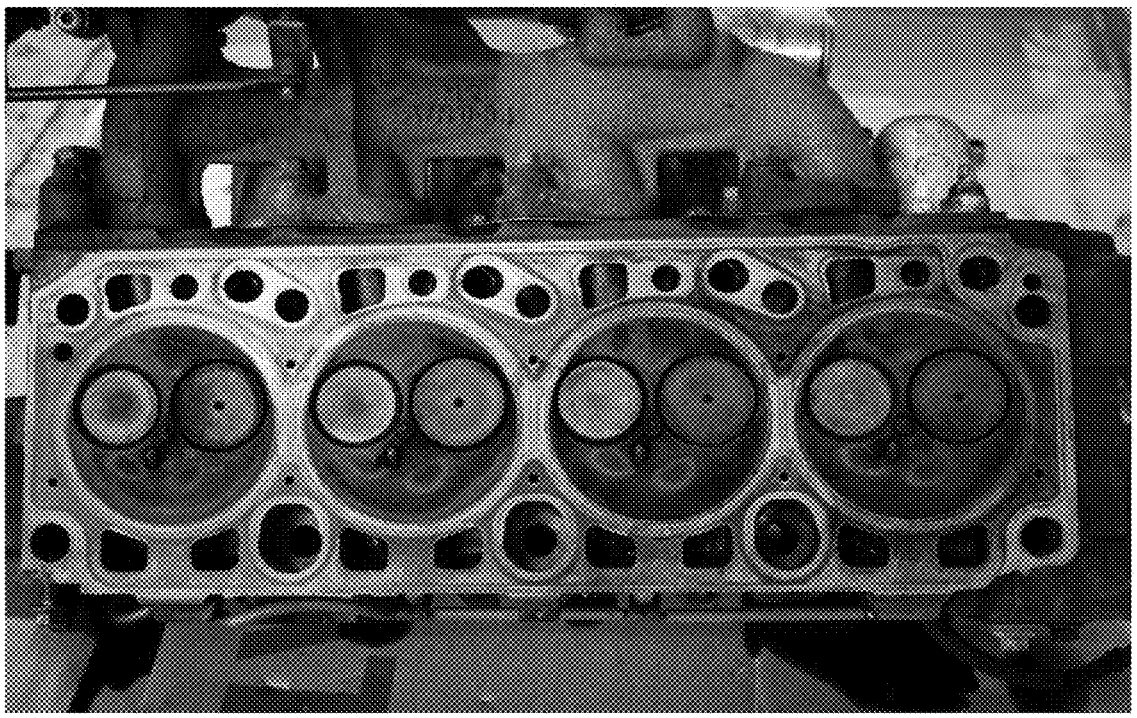
FIG. 1B shows a photo of the FORD Focus diesel motor after using the additive. 13 tablets of the additive (0.5 g each) were used, fuel consumption 520 l.
Figure 2A:
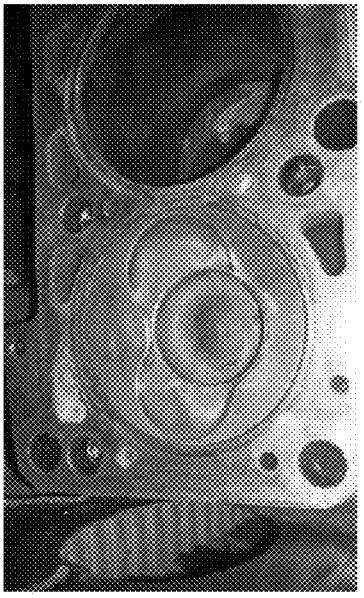
FIGS. 2A and 2B show photos of a Seat Leon motor, mileage 325 00 km. 20 tablets of additive (0.5 g each) were used, approximate fuel consumption 800 l.
Figure 2B:
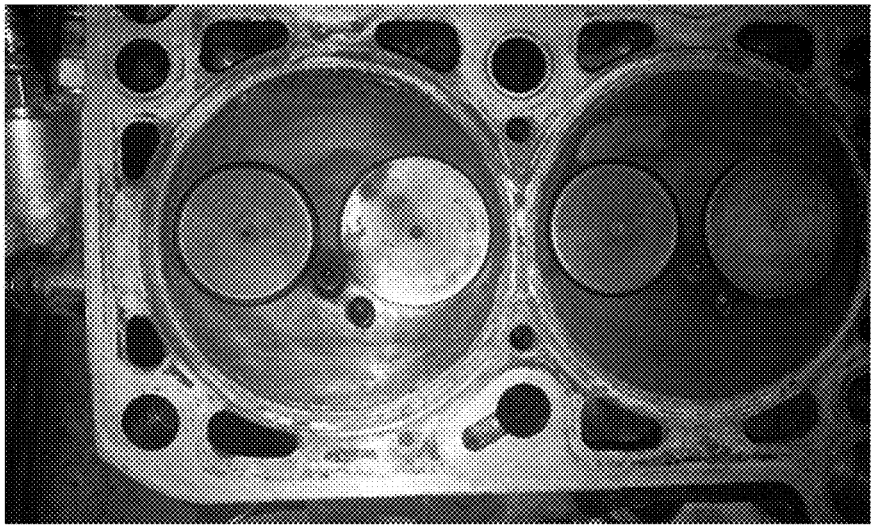
Figure 3:
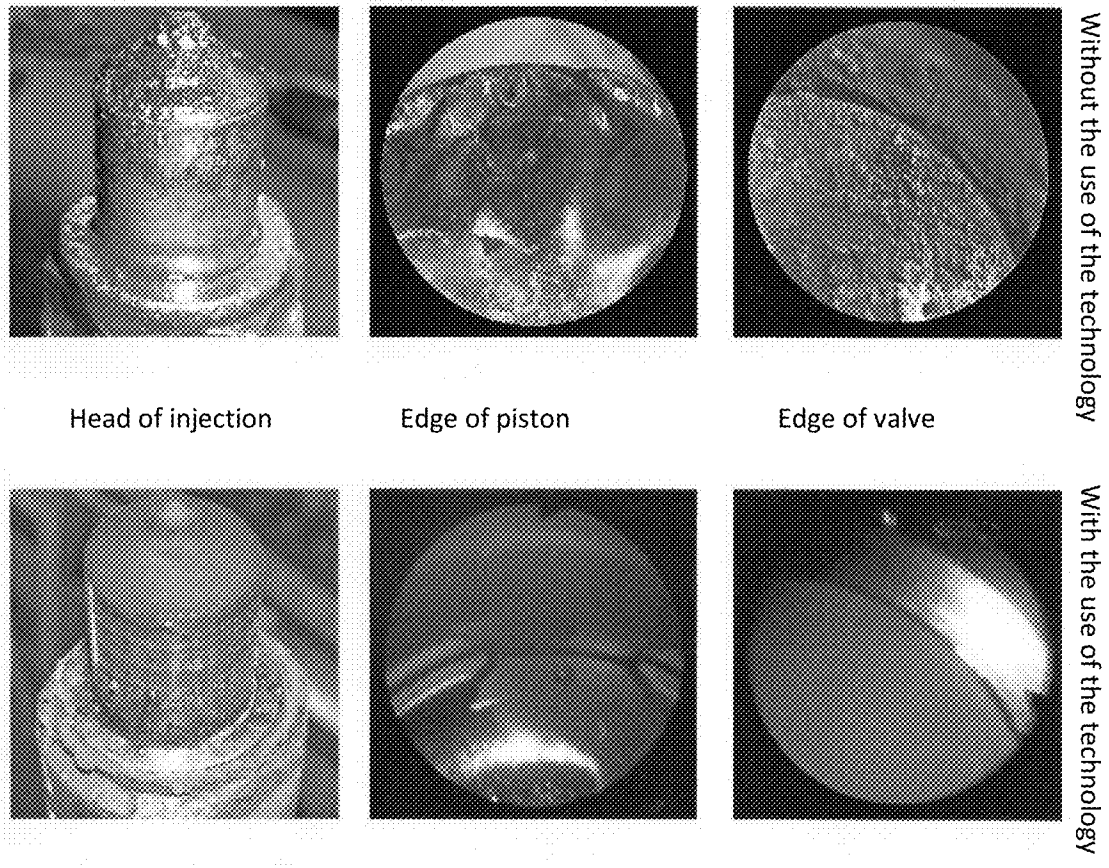
FIG. 3 shows photos of a diesel locomotive (series 740) motor before and after additive application. The locomotive was in operation 50 days and made over 9000 km.
Figure 4:
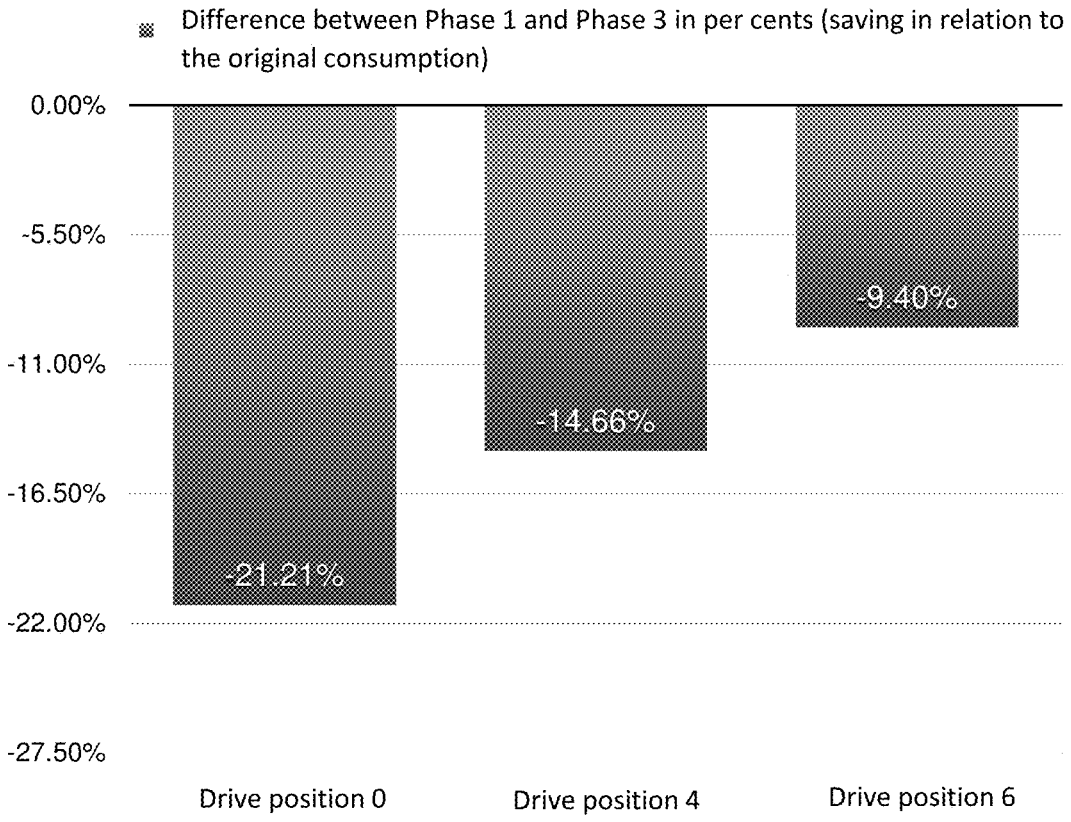
FIG. 4 shows the consumption difference measured according to example 5, after the additive application.

The mixture for production of the additive for liquid hydrocarbon fuels according to the present invention is prepared by mixing 80% by weight of Ferrocen, 10% by weight of Behenyl alcohol and 10% by weight of Lubritab. First, of the individual mixture components used are treated by grinding and sifting through a sieve with a sieve diameter of 0.2 mm. Thereafter, they are thoroughly mixed in order to create a homogenous mixture. This granulated material can be subsequently applied as such, or can be processed into another form required (tablets, solution).

Example 2

The mixture for production of the additive for liquid hydrocarbon fuels according to the present invention is prepared in a similar way as in the example 1, with the difference that it contains 80% by weight of Ferrocen, 5% by weight of Behenyl alcohol, 5% by weight of Lubritab and 10% by weight of magnesium stearate.

Example 3

The mixture for production of the additive for liquid hydrocarbon fuels according to the present invention is prepared in a similar way as in the example 1, with the difference that it contains 85% by weight of Ferrocen, 5% by weight of Behenyl alcohol, 5% by weight of Lubritab and 5% by weight of magnesium stearate.

Example 4

The mixture for production of the additive for liquid hydrocarbon fuels according to the present invention is prepared in a similar way as in the example 1, with the difference that it contains 90% by weight of Ferrocen, 5% by weight of Behenyl alcohol, 5% by weight of magnesium stearate.

Example 5

The additive for reducing emissions, carbon deposits and fuel consumption when combusting liquid hydrocarbon fuels and coal in the form of tablets is produced by pressing from above mentioned mixture according to the examples 1 to 4. Pressing conditions: air humidity maximum 30%, room temperature. The weight of the tablet is 0.5 g and the tablet is standardly intended for 40 litres of a liquid hydrocarbon fuel.

Example 6

The additive in the form of a liquid solution is produced by dissolving the mixture according to the examples 1 to 4. 25 g of this mixture are dissolved in 1 litre of a liquid hydrocarbon fuel. Preferably, such a liquid hydrocarbon fuel, in which the liquid solution will be applied, should be used for the dissolving. In case of preparing the additive for petrol, the petrol is used. When application of the additive to diesel oil is intended, the diesel oil is used.

Example 7

Testing of effects of the additive according to the present invention on carbon deposits removal The so-called carbon deposits are formed when combusting fuel in combustion engines. These deposits are deposited in the area of cylinders, especially on piston heads, valves, plugs and injectors, as well as in EGR valves, catalytic converters and solid particle filters. The deposited carbon acts abrasively. As a consequence of the carbon formation, the engine power is reduced, when the control unit reduces the ignition advance and thus, the fuel dosing is set to a fuel of a lower quality. Wear of inner parts of the engine, especially of piston rings, occurs. Knocking of valves arises.

Summary of the consequences mentioned above reduces the engine power, increases fuel consumption and can lead up to the engine damage.

The additive consisting of 80% of Ferrocen, 10% of Behenyl alcohol and 10% of cottonseed oil was tested in engines of passenger cars and in a locomotive engine.

The check on the motor cleaning effects was made by visual checking before and after the additive application. The engine was opened, alternatively photos of its state were taken by an endoscope. The results are shown in FIGS. 1A, 1B, 2A, 2B, 3.

The visual checking confirmed the additive effect on the engine cleaning.

Example 8

Testing of the additive effects on the reduction of the measured emissions

Evaluation of protocols from exhaust-emission measurement stations when using the additive according to the present invention.

Conditions and parameters in exhaust-emission measurement stations have become considerably tightened for owners of vehicles and machinery that are subject to exhaust-emission measurement checking. In Dec. 19, 2014, the Ministry of Transport approved a regulation changing the Regulation No. 302/2001 of code on technical inspections and exhaust-emission measurements of vehicles. The Regulation of Dec. 19, 2014 came into effect in Jan. 1, 2015 already. A gradual implementation of this Regulation will be completed in 2017 and it will be effective in full. It will not be substantially possible to elude the exhaust-emission measurement; the measurement protocols will be saved in a coded format and sent to a central database. Furthermore, the smoke emission limit for diesel engines was reduced by the value of 0.5 [$m^{-1}$]. Nowadays, the absorption coefficient corrected by the limit is stated among others in the so-called vehicle registration paper. This has already caused problems to approximately 25% of vehicle owners. The vehicle owners are primarily interested in the problem whether or not they will meet the exhaust-emission measurement limits of the exhaust-emission measurement stations (MOT). If they do not meet them, they are not allowed to undergo MOT inspection and the vehicle in question is put out of service. That is why we used protocols obtained from testing users of the additive to verify effects of emissions decrease.

We have divided the evaluation into petrol engines, diesel engines without DPF (Diesel Particulate Filter) and diesel engine with DPF. We have selected vehicles older than 6 years which could already have problems to meet the limits. Average values from the obtained protocols are indicated.

A considerable reduction of the measured emissions occurred in all cases. The additive used was composed of 80% of Ferrocen, 10% of Behenyl alcohol and 10% of cottonseed oil.

Petrol Engines

| | Without additive | With additive | Difference in % |
|---|---|---|---|
| Idle running | | | |
| CO content (in %) | 0.025 | 0.004 | 84.00% |
| HC content (unburnt hydrocarbon) (ppm) | 62 | 1 | 98.39 |
| Increased revolutions | | | |
| HC content (ppm) | 0.026 | 0.004 | 84.62% |
| HC content (ppm) | 57 | 2 | 96.49% |

Diesel Engines without DPF

| | Without additive | With additive | Difference in % |
|---|---|---|---|
| Smoke emission value [1/m] | 1.03 | 0.32 | 68.93% |

Diesel Engines with DPF

| | Without additive | With additive | Difference in % |
|---|---|---|---|
| Smoke emission value [1/m] | 0.25 | 0.02 | 92.00% |

Example 9

Test of the additive effects on fuel consumption decrease

The matter of fuel consumption decrease is one of the factors that drivers and vehicle and machine operators are most interested in. But it is a problem to prove this effect as accurately as possible. It is very difficult to create exactly the same conditions when driving a car in the process of testing in order to compare the fuel consumption without using the additive and with the use thereof. In a simplified way it can be stated that the fuel consumption as such depends first of all on where to, with what, how, which way and in which external conditions you are driving. This is almost impossible to be provided in common traffic, not even if you really do your best. Such conditions can be much approached perhaps on a racing track only. But the external influences (temperature, wind, rain) can definitely not be set.

Drivers most often come across the fuel consumption given in litres per 100 km and machine attendants come across it in litres per engine hour. It is an absolute quantity. It is thus a case of measuring the fuel volume per a unit mentioned regardless of the factors mentioned above, which are influencing it.

Use of the specific fuel consumption is the solution of the problem. The specific fuel consumption is a relative quantity. It is a fuel quantity consumed for the work produced. It is quoted in grams of fuel consumed per a kilowatt-hour. The specific fuel consumption varies at different engine revolutions. For that reason, to prove effects of the mixture according to the present invention on a consumption decrease it is necessary to perform measuring at several different engine revolutions.

It is very difficult to carry out such measuring in a vehicle. It would be necessary to install a whole range of measuring apparatuses, to monitor acceleration, altitude height change, etc. Therefore a motor, which is used for an electric energy generation, where the measuring of the specific fuel consumption can be performed best, is the suitable solution. Such measuring was performed on a diesel locomotive with an electric power transfer. The required quantities can be measured on locomotives without their being used on a railway track, so an influence of the railway track conditions and external conditions is eliminated. It is also possible to set the required load and engine revolutions. Electric quantities can be easily read. After taking the fuel circuit out of the fuel tank, even the fuel consumption can be measured accurately. Therefore, this is the most accurate measuring of the additive effects on the fuel consumption, which is possible to perform.

The tests were performed on a locomotive from the product line 740 with the numerical identification 740 899-0 that is operated by LOKOTRANS Service Comp. This locomotive is a four-axle diesel locomotive with an electric power transfer. Before taking the tests, a new power plant was installed in the locomotive, the new power plant being compression ignition engine K 6 S 230 DR that had gone through a required running-up. This engine is a vertical in-line, supercharged, six-cylinder, overhead-valve, water cooled engine with a direct fuel injection.

Measuring equipment: Measuring system developed by LOKOTRANS Service Comp. was used for the tests. This system consists in measuring the fuel consumption with accuracy in grams, the fuel consumption being related to the power generated for traction dynamo that is measured in kWh. The resulting value obtained is the fuel consumption in grams per one kWh. In case of setting the drive position 0 (idle), the measured quantity is the fuel consumption in grams per one hour. During the tests the locomotive was put out of operation and the generated power was led away into a connected resistor.

Test Procedure

The tests were performed in four phases.

Phase 1: The locomotive put out of operation, the measuring system installed. The fuel used: diesel fuel without additive. After reaching the operating temperature of the power plant and of the working fluids, measurement of the consumption was performed with drive positions 0, 4, 6.

Phase 2: The locomotive put into operation, the additive added in fuel in the form of tablets (one tablet contained 0.5 g of additive) in a ratio of 1 tablet of additive to 30 litres of fuel. The locomotive was in operation from Sep. 5, 2014 to Oct. 26, 2014 and 6000 litres of fuel were consumed. The additive composition: 80% of Ferrocen, 10% of Behenyl alcohol and 10% of cottonseed oil.

Phase 3: The locomotive put out of operation, the measuring system installed. Fuel used: diesel fuel with the additive in the ratio of 1 tablet to 30 litres of fuel. After reaching the operating temperature of the power plant and of the working fluids, measurement of the consumption was performed with drive positions 0, 4, 6. The additive composition: 80% of Ferrocen, 10% of Behenyl alcohol and 10% of cottonseed oil.

Phase 4: Evaluation of the measured quantities was performed by comparison of the values measured in Phase 1 and in Phase 3 (saving achieved when using the additive according to the present invention is the result). The obtained results are a part of this evaluation.

Record of Measuring without the Additive

| Drive position | U [V] | I [A] | P [kW] | Measuring time [s] | Fuel consumption [g] | Consumption [g/h, g/kWh] |
|---|---|---|---|---|---|---|
| 0 | 4 | 5 | 0 | 300 | 660 | 7920 |
| 4 | 394 | 798 | 314 | 300 | 6960 | 266 |
| 6 | 644 | 1281 | 825 | 120 | 6440 | 234 |

Measuring conditions without the additive: meteorological: cloudless, temperature 15° C., pressure 1010 hPa. Motor operating conditions: water temperature 60° C., oil temperature 60° C., oil pressure 550 kPa at 420 rpm. Oil type: motor-car oil Mogul M7 ADSIII, coolant: water.

Record of Measuring with the Additive

| Drive position | U [V] | I [A] | P [kW] | Measuring time [s] | Fuel consumption [g] | Consumption [g/h, g/kWh] |
|---|---|---|---|---|---|---|
| 0 | 5 | 3 | 0 | 300 | 520 | 6240 |
| 4 | 405 | 813 | 329 | 180 | 3740 | 227 |
| 6 | 592 | 1165 | 690 | 120 | 4880 | 212 |

Measuring conditions with the additive: meteorological: cloudless, temperature 8° C., pressure 1025 hPa. Motor operating conditions: water temperature 70° C., oil temperature 65° C., oil pressure 420 kPa at 425 rpm. Oil type: motor-car oil Mogul M7 ADSIII, coolant: water.

Evaluation of Tests of the Additive

| Drive position | Phase 1 without the additive Consumption [g/h, g/kWh] | Phase 3 with the additive Consumption [g/h, g/kWh] | Difference between Phase 1 and Phase 3 in the measured values | Difference between Phase 1 and Phase 3 in per cents (saving, as compared to the original consumption) | Difference between Phase 3 and Phase 1 in per cents (consumption increase without the additive) |
|---|---|---|---|---|---|
| 0 | 7920 | 6240 | −1680 | −21.21% | 26.92% |
| 4 | 266 | 227 | −39 | −14.66% | 17.18% |
| 6 | 234 | 212 | −22 | −9.40% | 10.38% |

Example 10

Test of Effects of the Additive on CO and PM (Dust Particles) Emissions

The exhaust-emission measuring was performed with the use of a mobile measuring device according to the utility model No. CZ21385 U1. The mobile device was attached to a car by means of a common tow bar. After the mobile device for combustion products draw-off had been connected and started, calibration of the engine exhaust gas analyser was performed according to the instructions of the producer. Volkswagen Transporter was the motor car tested. It is a box-type truck of N1 category (a special breakdown truck). The vehicle was manufactured in 2000 and homologated according to the European Parliament and European Council directive 98/69/ES, so it meets the exhaust emission limits Euro 2. The vehicle went through regular services in an authorized service centre. The car had 158 667 km on the clock before the start of testing. It is propelled by five-cylinder compression ignition engine with supercharging by exhaust turbocharger. The exhaust emission system consists of an oxidation catalytic converter, a central and a rear muffler. The system bears the marks of corrosion, but its tightness is unspoiled. The measuring was made in city traffic and in a non-city traffic round the city of Brno, CZ. The measuring route creating a closed circuit was led on B-roads, non-primary routes and village roads. The total length of the circuit is 11 km. The difference in altitude between the lowest and the highest point of the circuit is 156.5 m.

Figure 5:
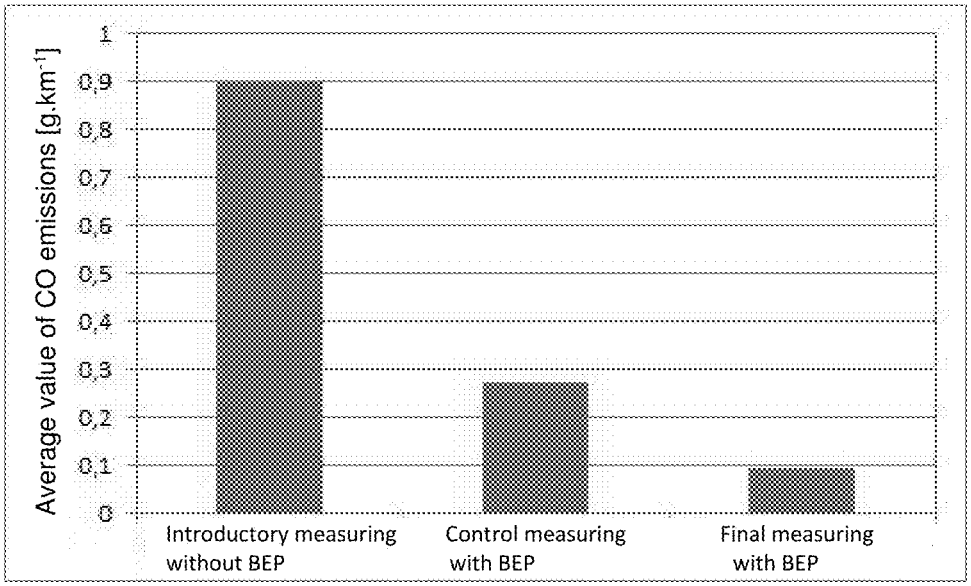
FIG. 5 shows the decrease of CO emissions after application of the additive according to the present invention (BEP=additive consisting of 80% of Ferrocen, 10% of Behenyl alcohol and 10% of cottonseed oil).
Figure 6:
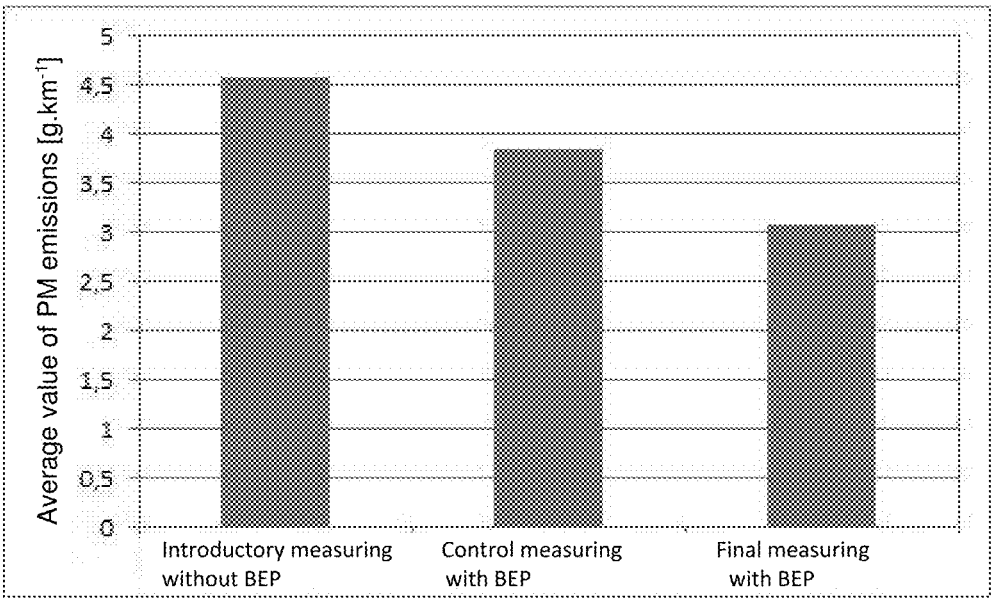
FIG. 6 shows the decrease of solid particles emission when applying the additive according to the present invention (BEP=additive consisting of 80% of Ferrocen, 10% of Behenyl alcohol and 10% of cottonseed oil).

The introductory measuring (without the added additive) was carried out in May 2016. In the period from June 2016 to September 2016 the vehicle was operated with the addition of the supplied fuel additive composed of 80% of Ferrocen, 10% of Behenyl alcohol and 10% of cottonseed oil and a check measurement was carried out in October 2016. In the period from May 2017 to October 2017 the vehicle was operated again with the addition of the same supplied fuel additive. The final measuring of the exhaust emission was carried out in October 2017. By the end of the experiment the vehicle covered further 5224 km with the agent. During this period 455.44 litres of diesel oil had been refuelled and 16.5 tablets in total had been applied. The measured values of the CO and PM emissions are demonstrated in diagrams in FIGS. 5 and 6 and they clearly prove a significant influence of the additive on the CO and PM emissions decrease.

INDUSTRIAL APPLICABILITY

Granulated material, tablets or a liquid solution produced from the mixture mentioned above can be advantageously used in all liquid hydrocarbon fuels for combustion engines. This mixture in the form of tablets is easy to be dosed into vehicle and machine tanks. It dissolves quickly enough when the fuel is moving in the tank. The fuel gains much better properties in the combustion process. The designed mixture acts as a catalyst of combustion. Besides, a gradual and safe cleaning of inner spaces of boilers and combustion engines, valves, injections, plugs and measuring sensors and the whole of exhaust emission system including catalytic converters and solid particle filters comes about. Also exhaust gas emissions including dust particles measured in Exhaust emission measurement stations are considerably reduced. The vehicle dynamics is improved. The fuel consumption is decreased. When used in stationary tanks without movement of the fuel, the tablets or granulated material must be dissolved first in a small quantity of the fuel and only after their being dissolved, the mixture can be applied into the tank before it being filled. To treat 2000 litres of fuel, 25 g of tablets or granulated material is dissolved in 1 litre of the fuel. The liquid solution made in this way can be applied into the stationary tank before it being filled.

The invention claimed is:

1. A fuel composition for reducing emissions, carbon deposits and fuel consumption at liquid hydrocarbon fuels combustion, the fuel composition comprising: 80 to 90 percent by weight of ferrocene; behenyl alcohol; and at least one of hydrogenated cottonseed oil and magnesium stearate; wherein each of the behenyl alcohol, the hydrogenated cottonseed oil and/or the magnesium stearate is present in the composition in an amount up to 10 percent by weight.

2. The fuel composition according to claim 1, comprising 80 percent by weight of the ferrocene, 10 percent by weight of the behenyl alcohol, and 10 percent by weight of the hydrogenated cottonseed oil.

3. The fuel composition according to claim 1, comprising 80 percent by weight of the ferrocene, 5 percent by weight of the behenyl alcohol, 5 percent by weight of the hydrogenated cottonseed oil, and 10 percent by weight of the magnesium stearate.

4. The fuel composition according to claim 1, comprising 85 percent by weight of the ferrocene, 5 percent by weight of the behenyl alcohol, 5 percent by weight of the hydrogenated cottonseed oil, and 5 percent by weight of the magnesium stearate.

5. The fuel composition according to claim 1, comprising 90 percent by weight of the ferrocene, 5 percent by weight of the behenyl alcohol, and 5 percent by weight of the magnesium stearate.

6. An additive for liquid hydrocarbon fuels, the additive comprising the fuel composition according to claim 1.

7. The additive according to claim 6, in the form of a loose granulated material or a pressed tablet.

8. The additive according to claim 6, further defined as a solution comprising the fuel composition according to claim 1 and a liquid hydrocarbon fuel.

9. The additive according to claim 8, comprising 3 to 5 percent by weight of the fuel composition, and the remainder liquid hydrocarbon fuel, wherein the fuel composition is completely dissolved in the liquid hydrocarbon fuel.

10. The additive according to claim 9, wherein the liquid hydrocarbon fuel is selected from liquid hydrocarbon fuels for combustion engines or liquid hydrocarbon fuels for boilers.

11. The additive according to claim 10, wherein the liquid hydrocarbon fuel is selected from the group consisting of gasoline or petrol, diesel oil, paraffin oil, aviation gasoline or aviation petrol, fuel oil, and solvent naphtha.

12. A fuel for combustion engines or liquid fuel boilers, the fuel comprising the fuel composition according to claim 1.

13. The fuel according to claim 12, wherein the fuel is a liquid hydrocarbon fuel, the ratio of the fuel composition to the fuel is in the range of from 1:80 to 1:60 (g:L) gram of the composition (g) to litres of the fuel (L), and the fuel composition is completely dissolved in the fuel.

* * * * *